United States Patent [19]

Landwehrkamp

[11] 4,068,456

[45] Jan. 17, 1978

[54] OPEN-END SPINNING DEVICE

[75] Inventor: Hans Landwehrkamp, Lenting, Germany

[73] Assignee: Schubert & Salzer, Ingolstadt, Germany

[21] Appl. No.: 726,805

[22] Filed: Sept. 27, 1976

[30] Foreign Application Priority Data

Oct. 4, 1975 Germany ..... 2544503

[51] Int. Cl.[2] ..... D01H 1/12

[52] U.S. Cl. ..... 57/58.89

[58] Field of Search ..... 57/58.89–58.95

[56] References Cited

U.S. PATENT DOCUMENTS

| | | | |
|---|---|---|---|
| 3,481,128 | 12/1969 | Landwehrkamp et al. | 57/58.89 |
| 3,822,541 | 7/1974 | Croasdale et al. | 57/58.89 |

*Primary Examiner*—Richard C. Queisser
*Assistant Examiner*—Charles Gorenstein
*Attorney, Agent, or Firm*—Bailey, Dority & Flint

[57] ABSTRACT

An open-end spinning machine including a spinning rotor having walls which converge together at an angle of at least 40° to define a collecting channel at the junction therebetween. A thread draw-off nozzle projects into the spinning rotor and has a curved thread contact surface. The radius of curvature of the thread contact surface is between 7.5 and 8.5 mm. Such enables yarn to be produced with a rotor speed of between 50,000 and 70,000 revolutions per minute.

3 Claims, 1 Drawing Figure

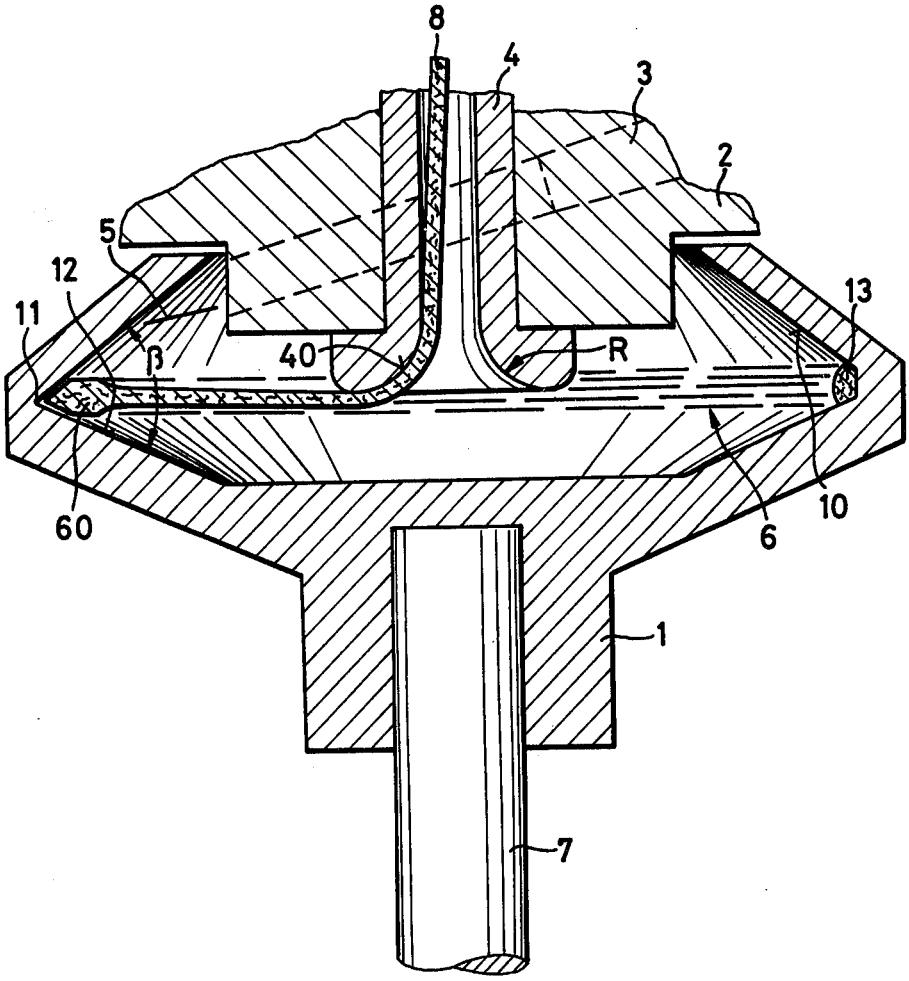
8
4
3
2
5
12
11
13
β
40
R
60
6
10
1
7

OPEN-END SPINNING DEVICE

BACKGROUND OF THE INVENTION

The present invention relates to an open end spinning device and, more particularly, to an open end spinning device which has a spinning rotor which is driven at speeds of between 50,000 and 70,000 rp.m.s. for producing yarns having a low limiting twist coefficient.

It is known that open-end yarns must be twisted harder than ring-spun yarns and, consequently, exhibit a harder feel (Melliand-Textilberichte 2/52 (1971), pages 127–132). For many purposes, e.g., for knitwear and hosiery, ring-spun yarns are for that reason preferred to open-end yarns, In order to broaden the field of use of open-end yarns it is therefore necessary to reduce the twist in the yarn. A reduction in the twist means a low twist coefficient $\alpha$. But at the same time an increase in production is thereby achieved through increased thread draw-off speed at the same rotational speed of the rotor (Melliand Textilberichte 2/1975, pages 98–104).

It is further known that by increasing the false twist effect, the limiting twist coefficient $\alpha_{min}$ can be reduced. For this purpose, thread draw-off tube mouths have become known, which are provided with grooves or ribs (West German A/S 1 560 302, and U.S. Pat. Nos. 3,640,061 and 3,805,505. But these mouths cause roughening of the thread and for that reason cannot be used arbitrarily.

SUMMARY OF THE INVENTION

In solution of this problem in accordance with the invention, the spinning rotor is driven at a speed of revolution between 50,000 and 70,000 r.p.m., while the thread contact surface exhibits a radius of curvature between 7.5 and 8.5 mm. In order to avoid roughening of the yarn, the thread draw-off nozzle in particular with fine yarn counts is provided with a smooth thread contact surface. The thread draw-off nozzle may be produced from various materials, but a thread contact surface consisting of metal has proved particularly advantageous. Preferably, the walls forming the collecting channel include an angle between 40° and 60°. For achievement of a particularly low limiting twist coefficient, in accordance with a further feature of the invention, the spinning rotor exhibits a blunted collecting channel.

With the device in accordance with the invention, it is possible to reduce the limiting twist coefficient to $\alpha_{min} = 80$ and even lower, with draw-off speeds of 210 m/min being made possible. In spite of these extreme values perfect piecing is possible by means of the device in accordance with the invention.

Accordingly, it is an object of the present invention to provide an open end spinning device wherein a particularly designed rotor is driven at high speeds for spinning yarns with a low limiting twist coefficient at a high rate of production.

Another important object of the present invention is to provide a rotor for an open end spinning device which enables yarn to be produced at a high production rate which have a good hand.

These and other objects and advantages of the invention will become apparent upon reference to the following specification, attendant claims, and drawing.

BRIEF DESCRIPTION OF THE DRAWING

The drawing illustrates in cross section a spinning rotor for an open end spinning machine constructed in accordance with the present invention which for the sake of simplicity, two different possible shapes of collecting channels are shown in the right hand and left hand halves of the figure.

DESCRIPTION OF THE PREFERRED EMBODIMENT

The spinning rotor 1 is in a manner not shown, supported by means of a shank 7 in a housing of which only the cover 2 can be seen in the drawing, by means of which the open side of the rotor is covered. The cover 2 in a known manner contains a fiber feed channel 3 directed towards the upper slip wall 10 of the spinning rotor 1. In addition, a thread draw-off nozzle 4 is supported in the cover 2 centrally with respect to the spinning rotor 1.

The spinning rotor 1 exhibits a collecting channel 11 which is formed by the slip wall 10 and the lower conical wall 12. In the collecting channel 11, the fibers being fed through the fiber feed channel 3 across the slip wall 10 are gathered into the form of a thin sliver 6. The slip wall 10 and the conical wall converge together at an angle $\beta$ of at least 40°. The spinning rotor 1 is driven by means of a drive (not shown) at a speed of rotation of from 50,000 to 70,000 r.p.m. The thread 8 connected via the splicepoint 60 to the sliver 6 is therefore pressed at relatively high pressure against the curved thread contact surface 40 of the thread draw-off nozzle 4. As illustrated, the draw-off nozzle 4 has a bore extending therethrough. It has been found that a particularly intensive propagation of twist is achieved when the thread contact surface has a radius of curvature R of 7.5 to 8.5 mm. If the radius of curvature R is smaller, the limiting twist coefficient $\alpha_{min}$ must be raised. If the radius of curvature R is greater, the friction is so high that the thread 8 gets continuously twisted off at the splicepoint 60.

It has been found that for spinning a thread 8 with a limiting twist coefficient $\alpha_{min}$ which is extremely low for open end spinning, it is necessary to fulfill simultaneously the three conditions stated below:

a. Maintenance of a rotor speed between 50,000 and 70,000 r.p.m. If the speed is reduced the limiting twist coefficient $\alpha_{min}$ increases. If the rotor speed increases, the forces of air friction and the centrifugal forces in the spinning rotor 1 increase so that the number of thread breakages rises rapidly.

b. The radius of curvature R of the thread contact surface 40 on the thread draw-off nozzle 4 is between 7.5 and 8.5 mm. If the radius of curvature R is reduced, the generation of false twist is inadequate for splicing the fibers 5 at the splicepoint 60 securely into the end of the thread 8. Hence, an increase in the true twist in the thread 8 is necessary and, hence, also an increase in the limiting twist coefficient $\alpha_{min}$. If the radius of curvature R is increased beyond 8.5 mm, the imparting of false twist increases to such an extent that the thread 8 gets overtwisted at the splicepoint 60 — and twisted off.

c. An angle $\beta$ of at least 40° between the walls 10 and 12 including the collecting channel 11. It has been found that in a more acute collecting channel 11 poorer splicing of the fibers 5 is achieved than in a not so acute collecting channel 11. It is assumed that because of the resistance to torsion in the sliver 6 the propagation of twist in the more open collecting channel 11 is impeded, so that the twist gets concentrated over a smaller length. The collecting channel 11 may in that case exhibit a rounded or angular profile.

It has been found that through the combined application of the features stated above, it is possible to reduce the limiting twist coefficient $\alpha_{min}$ extremely heavily — partly down to a value below 80 — and at the same time to raise the thread-draw-off speed — partly up to 210 m/min and more, which the respective features alone are not in a position to do.

With coarse yarns, the application of a notched or rough thread contact surface 40 is possible. With fine yarn counts, however, a smooth thread contact surface 40 has proved necessary. The thread draw-off nozzle 4 or even only the thread contact surface 40 may consist of different materials, e.g., of ceramic. The best results are achieved, however, with a thread contact surface 40 consisting of metal.

As mentioned above, for achieving the results being striven for, a collecting channel 11 is necessary, the walls 10 and 12 of which include an angle $\beta$ of at least 40° as is shown in the left hand half of the figure. Preferably the angle in this case amounts to 40° to 60°. In this way, satisfactory sliding of the fibers 5 along the slip wall 10 and into the collecting channel 11 is guaranteed and on the other hand, good splicing of the fibers at the splicepoint 60 is guaranteed. Under certain circumstances, it is advantageous to provide a blunted collecting channel 13 having a flat or flattened bottom in order to concentrate the twist still more at the splicepoint 60. This is shown in the right hand half of the figure.

The present invention enables extension of the field of application of open-end yarns to ranges which heretofore were reserved to ring-spun yarns. Simultaneously with the softer feel of the thread 8 produced because of the smaller limiting twist coefficient $\alpha_{min}$, a not inconsiderable rise in production is also achieved.

The invention establishes the teaching that the way to economically produce yarn by open-end rotor spinning does not require continuous increase in rotor r.p.m. for higher production, since by doing this, the necessary power requirements, problems of rotor journalling and creation of noise arises to a disproportionate degree, and can only be solved by considerable technical outlay. Contrary to known tendencies, it has been recognized that the summation of quite specific factors leads to optimum which allows open-end yarns to be produced economically for an even greater range of application. The application of this sum of specific factors means nearly doubling the production as compared with that heretofore.

While a preferred embodiment of the invention has been described using specific terms, such description is for illustrative purposes only, and it is to be understood that changes and variations may be made without departing from the spirit or scope of the following claims.

What is claimed is:

1. A spinning rotor for use in an open-end spinning device for producing twisted open-end yarns while said spinning rotor is driven at speeds of between 50,000 and 70,000 revolutions per minute, said spinning rotor comprising:

a. upper and lower walls converging together at an angle of between 40° and 60° defining a collecting channel for yarn being produced at the junction of said upper and lower wall, b. a thread draw-off nozzle extending into said rotor, c. a bore extending through said thread draw-off nozzle, and d. a thread contact surface surrounding a lower end of said bore over which yarn being produced in said rotor passes to exit through said draw-off nozzle, e. said thread contact surface having a radius of curvature between 7.5 and 8.5 mm.

2. The spinning rotor as set forth in claim 1 wherein said thread contact surface is smooth and constructed of metal.

3. The spinning rotor as set forth in claim 1 wherein the base of said collecting channel is blunted.

* * * * *